United States Patent [19]

DeMaio et al.

[11] Patent Number: 5,040,672

[45] Date of Patent: Aug. 20, 1991

[54] ARTICLE CARRIER AND BLANK THEREFOR

[75] Inventors: James B. DeMaio, Marietta; James T. Stout, Acworth, both of Ga.

[73] Assignee: The Mead Corporation, Dayton, Ohio

[21] Appl. No.: 630,879

[22] Filed: Dec. 20, 1990

[51] Int. Cl.[5] ..... B65D 75/00; B65D 5/48

[52] U.S. Cl. ..... 206/162; 206/188

[58] Field of Search ..... 206/162, 181, 188, 184, 206/166; 229/120.18

[56] References Cited

U.S. PATENT DOCUMENTS

| | | | |
|---|---|---|---|
| 2,687,232 | 8/1954 | Arneson | 206/188 |
| 2,905,359 | 9/1959 | Arneson | 206/184 |
| 3,105,608 | 10/1963 | Engel | 206/166 |
| 3,432,073 | 3/1969 | Forrer | 206/188 |
| 3,850,292 | 11/1974 | Mahizza et al. | 206/181 |
| 3,917,058 | 11/1975 | Wood | 206/181 |
| 4,308,950 | 1/1982 | Wood | 206/188 |
| 4,311,269 | 1/1982 | Montealegre | 229/120.18 |
| 4,313,554 | 2/1982 | Montealegre | 229/120.18 |
| 4,465,181 | 8/1984 | Wood | 206/188 |

FOREIGN PATENT DOCUMENTS

| | | | |
|---|---|---|---|
| 2418615 | 5/1975 | Fed. Rep. of Germany | 206/162 |

*Primary Examiner*—William I. Price

*Attorney, Agent, or Firm*—Rodgers & Rodgers

[57] ABSTRACT

A basket style article carrier includes a bottom wall, a pair of side walls foldably joined to opposite side edges of the bottom wall, end panels foldably joined to each end of each side wall, a riser panel foldably joined to the inner edge of the end panels at one end of the carrier, a pair of medial panels foldably joined respectively to the inner edges of the end panels at the other end of the carrier, a pair of handle panels foldably joined respectively to the medial panels and secured in flat face contacting relation with the medial panels, cross partition structure foldably joined to each medial panel and a longitudinal reinforcing beam panel foldably joined along its top edge to the bottom edge of one medial panel and secured at one end to one of the medial panels and at the other end to one of the riser panels.

11 Claims, 4 Drawing Sheets

ARTICLE CARRIER AND BLANK THEREFOR

TECHNICAL FIELD

This invention relates to article carriers of the basket style and is concerned particularly with the provision of structure which is mechanically strong, economical and durable.

BACKGROUND ART

U.S. Pat. No. 3,432,073 issued Mar. 11, 1969 discloses a basket style article carrier which includes a medial strut to which cross partition elements are foldably joined. In this patent, the partition structure is folded downwardly about the upper edge of the medial strut to which the cross partition elements are foldably joined. This patent is devoted to special handle structure and is primarily concerned with affording protection for packaged articles which extends a substantial distance from the bottom parts of the packaged items to the top portions thereof. This patent is not concerned primarily with providing reinforcing medial structure whereby a basket carrier is rendered mechanically strong and substantially rigid from one end to the other particularly along its medial elements.

Also of interest are the following patents:

U.S. Pat. No. 2,687,232
U.S. Pat. No. 2,820,572
U.S. Pat. No. 2,905,359
U.S. Pat. No. 3,105,608
U.S. Pat. No. 3,850,292
U.S. Pat. No. 3,917,058
U.S. Pat. No. 4,311,269
U.S. Pat. No. 4,313,554
843,718 British
74 11 248.4 German filed 3/30/75

SUMMARY OF THE INVENTION

According to this invention in one form, a carrier of the basket style is provided and includes a special blank having bottom and side walls together with end wall panels and medial panel structure arranged in substantially conventional fashion together with cross partition structure on each side of the medial panels. To the lower edge of one medial panel a longitudinal reinforcing beam panel is foldably joined and secured at one end thereof to said one medial panel and at the other end to riser panels which form inward extensions of the end panels at the opposite end of the carrier.

BRIEF DESCRIPTION OF THE DRAWINGS

FIG. 6 shows a completed carrier in collapsed condition while

BEST MODE OF CARRYING OUT THE INVENTION

Figure 1:
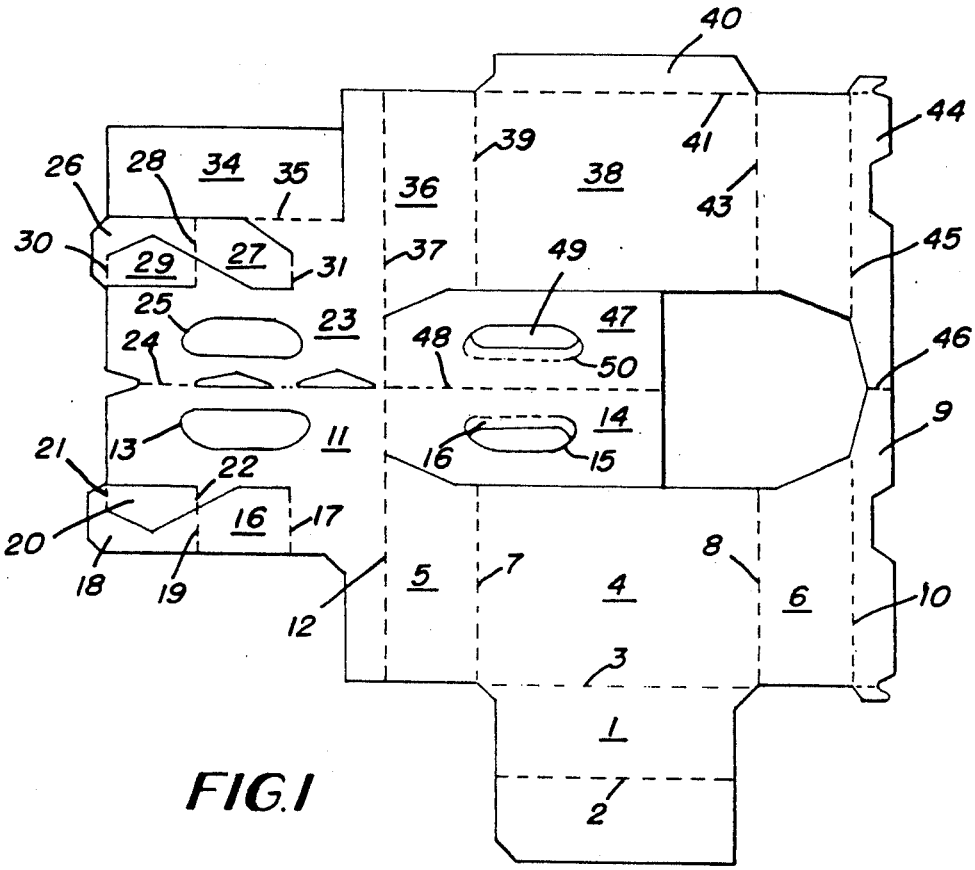
FIG. 1 is a plan view of a blank formed according to this invention as viewed from the inside of the blank.

In the drawings, the numeral 1 designates the bottom wall of the carrier. A medial fold line 2 is formed in bottom wall 1. The bottom wall is foldably joined along fold line 3 to the bottom edge of side wall 4. End panels 5 and 6 are foldably joined respectively to the end edges of side wall 4 along fold lines 7 and 8. A riser panel 9 is foldably joined to end panel 6 along fold line 10. Medial panel 11 is foldably joined to end panel 5 along a fold line 12. A hand gripping aperture 13 is formed in medial panel 11. Handle panel 14 is foldably joined to medial panel 11 along fold line 12 and is provided with hand gripping aperture 15 to an edge of which a hand cushioning flap 16 is foldably joined. A cross partition strap 16 is foldably joined to medial panel 11 along a fold line 17 and is foldably joined to anchoring flap 18 along a fold line 19. A transverse strap 20 is foldably joined to anchoring panel 18 along fold line 21 and to medial panel 11 along fold line 22.

On the other side of the carrier, a medial panel 23 is foldably joined to medial panel 11 along an interrupted fold line 24 and is provided with a hand gripping aperture 25. An anchoring flap 26 is foldably joined to cross partition strap 27 along fold line 28 and cross partition strap 29 is foldably joined to anchoring panel 26 along a fold line 30 and cross partition strap 27 is foldably joined to medial panel 23 along fold line 31.

A longitudinal reinforcing beam panel 34 is foldably joined to medial panel 23 along fold line 35. End panel 36 is foldably joined to medial panel 23 along fold line 37 which is aligned with fold line 12. End panel 36 is foldably joined to side wall 38 along a fold line 39. Glue flap 40 is foldably joined to side wall 38 along fold line 41 and end panel 42 is foldably joined to side wall 38 along a fold line 43. Riser panel 44 is foldably joined to end panel 42 along a fold line 45 and riser panels 44 and 9 are foldably joined to each other along short fold line 46. Handle panel 47 is foldably joined to medial panel 23 along fold line 37 and is also foldably joined to handle panel 14 along medial fold line 48. Hand gripping aperture 49 and associated hand cushioning panel 50 are of conventional construction.

The blank of FIG. 1 is manipulated initially by simply folding the longitudinal reinforcing beam panel 34 downwardly and underneath the cross partition structure comprising anchoring flap 26 and straps 29 and 27. The blank then appears as shown in FIG. 2.

Figure 2:
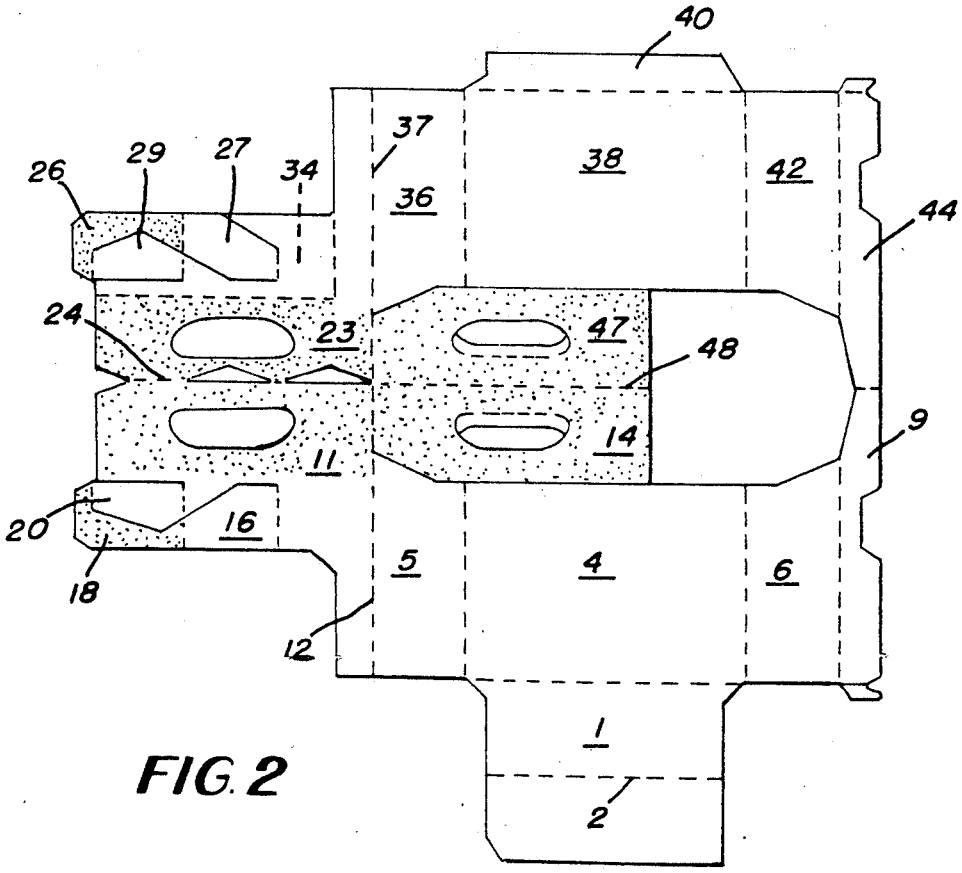
FIG. 2 is a view similar to FIG. 1 following a first folding operation whereby a longitudinal reinforcing beam panel is folded downwardly from the position shown in FIG. 1 to that indicated in FIG. 2.

An application of glue is then made to the blank as shown in FIG. 2 and as represented by stippling in that figure. Thereafter medial panels 11 and 23 together with anchoring panels 18 and 29 and their associated cross partition straps along with longitudinal reinforcing beam panel 34 are elevated and folded toward the right along fold lines 12 and 37. This operation causes the anchoring flaps 18 and 26 to become adhered respectively to side walls 4 and 38 and also causes the medial panels 11 and 23 to become adhered to the handle panels 14 and 47. The blank then appears as shown in FIG. 3.

Figure 3:
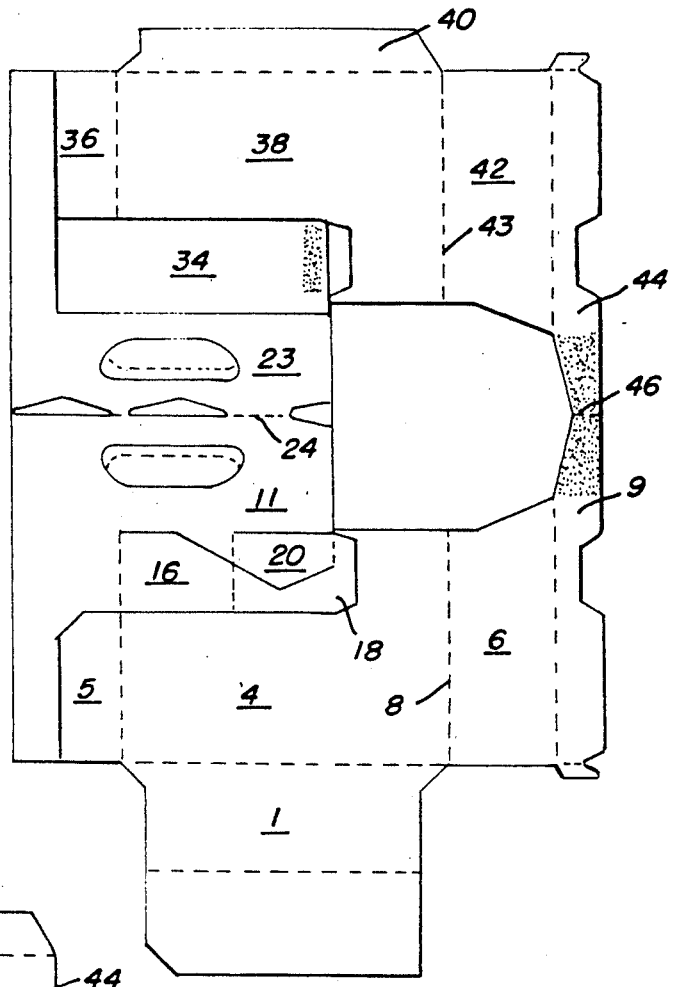
FIGS. 3, 4 and 5 depict sequential folding operations

An application of glue is then made to the riser panels 9 and 44 and to the right hand end of longitudinal reinforcing beam panel 34 as indicated by stippling in FIG. 3. Thereafter end panels 6 and 42 are elevated and folded to the left along fold lines 8 and 43 and into the positions indicated in FIG. 4. This operation causes the riser panels 44 and 9 to become adhered to the medial panels 23 and 11 and also causes the riser panel 44 to become adhered to the right hand end of longitudinal reinforcing beam panel 34 and the blank then appears as shown in FIG. 4.

Figure 4:
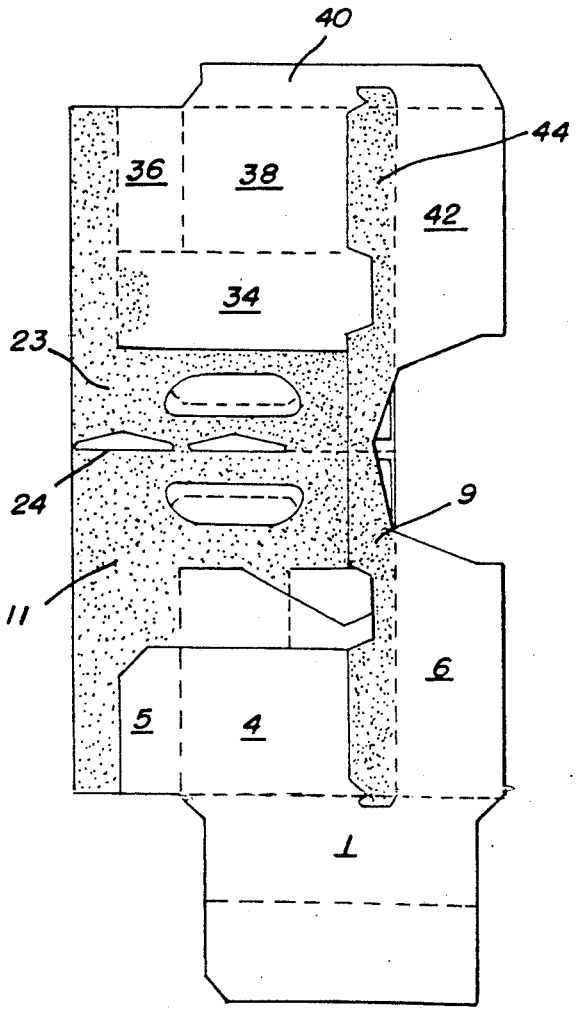

An application of glue is then made to the riser panels 44 and 9, to the medial panels 11 and 23 and to the left hand end of longitudinal reinforcing beam panel 34 all as indicated by stippling in FIG. 4. Thereafter side wall 38, end panels 36, 42 and glue flap 40 as well as medial panel 23 and longitudinal reinforcing beam panel 34 are elevated and folded forwardly along the fold lines 24, 46 and 48 forwardly and into the position represented in FIG. 5. This operation causes the riser panels 44 and 9 to become adhered to each other and causes the medial panels 11 and 23 to become adhered to each other and also causes the left hand end of longitudinal reinforcing beam panel 34 to become adhered to medial panel 11. Thus the longitudinal reinforcing beam panel 34 is adhered at one end to medial panel 11 and at the other end to riser panel 44 so as to constitute a mechanically strong and rigid beam disposed medially of the carrier underneath the handle. Upon completion of these folding operations, the carrier then appears as shown in FIG. 5.

Figure 5:
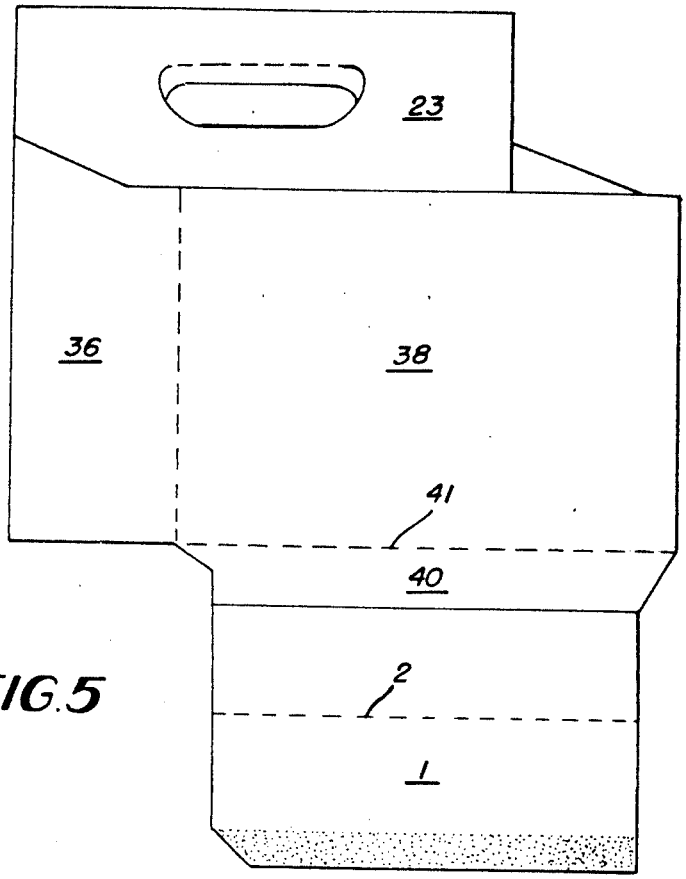
Figure 6:
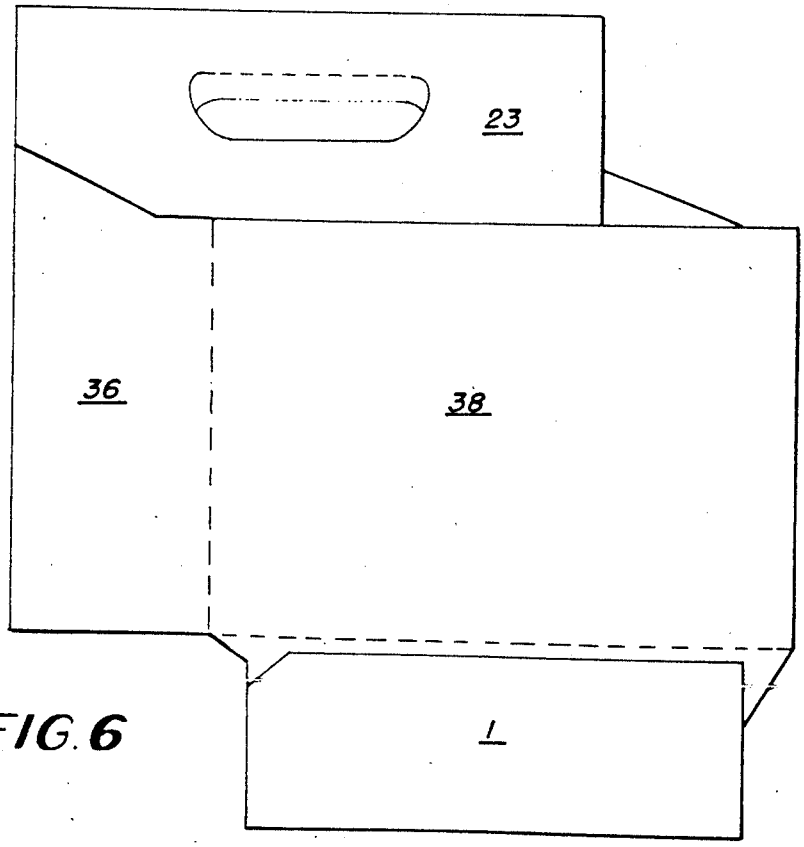
Figure 7:
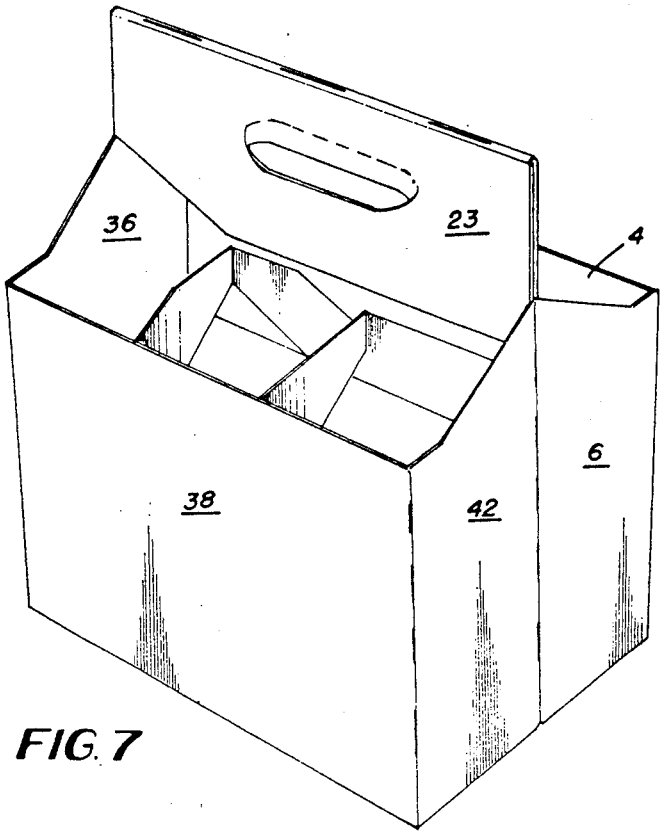
FIG. 7 shows the completed carrier in set up condition ready for loading and FIG. 8 shows several carrier blanks formed according to this invention and arranged in nested relation with each other whereby substantial economy in the use of paperboard are effected according to one feature of this invention.

An application of glue is then made to the edge of bottom wall 1 as indicated by stippling in FIG. 5. The bottom wall 1 is then folded along its medial fold line 2 so as to cause the stippled edge of bottom wall 1 to become adhered to the glue flap 40 and the carrier then appears in collapsed condition, as shown in FIG. 6 and when set up appears as shown in FIG. 7.

Figure 8:
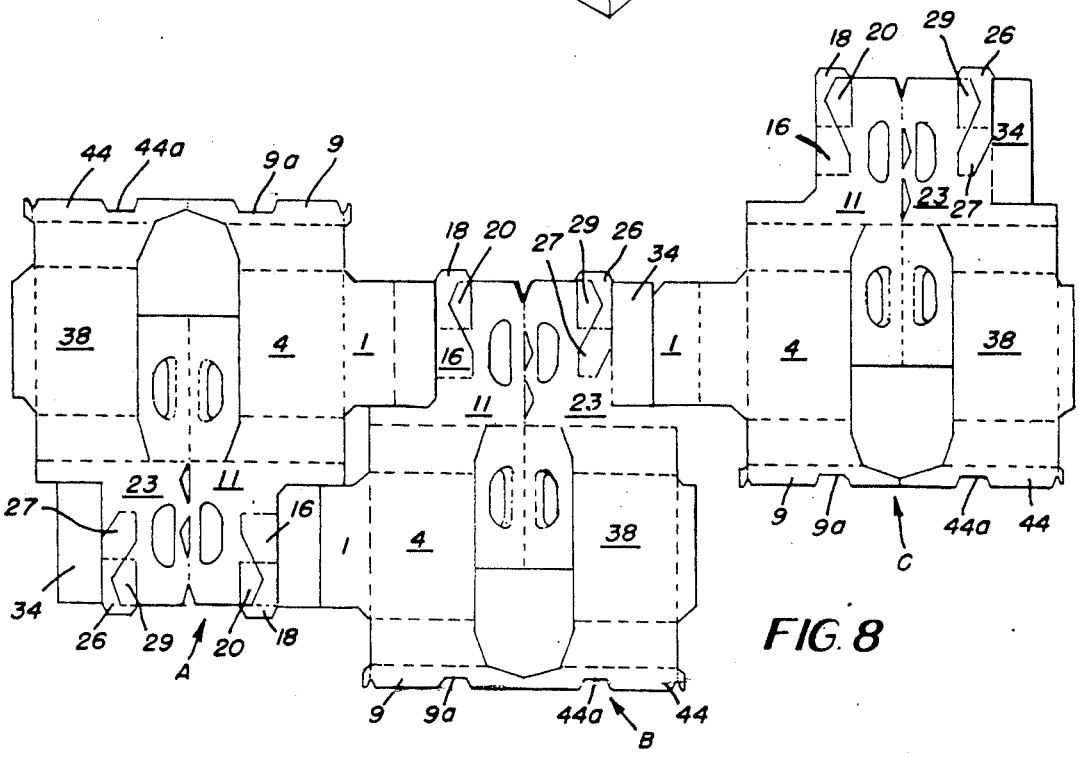

One feature of this invention centers around the fact that the carrier blank is well adapted to nesting with adjacent identical carrier blanks cut from a single piece or strip of paperboard material. In this connection, FIG. 8 shows three identical carrier blanks formed according to this invention and designated by the letters A, B and C whereby blank B is disposed in a position which is rotated clockwise 180 degrees with respect to blank A whereas blank C is disposed in the same orientation as blank B but is offset to one side thereof. As a result, bottom walls 1 of blanks A and B extend into the recesses provided in the medial panels 11 of blanks B and A, respectively, while the longitudinal reinforcing beam panel 34 of blank B is positioned adjacent and engages bottom wall 1 of blank C. The recess provided in the medial panel 11 of each blank is dimensioned and sized so that it corresponds substantially to the width of the bottom wall 1 whereby the exposed end edge of bottom walls 1 of blanks A and B are aligned substantially with the free end edges of the cross partition structures. Also, the exposed end edge of the longitudinal reinforcing beam panel 34 of blank B coincides with the exposed end edge of bottom wall 1 of blank C. The three blank arrangement as shown in FIG. 8 as a whole is also adapted to nest with a like three-blank arrangement in side-by-side relationship. To this end, the notches 44*a* and 9*a* of blank A can receive the projecting portions of anchoring flaps 26 and 18 of an adjacent blank A. In like fashion, the notches 9*a* and 44*a* of blanks B and C are adapted to receive the projecting portions of anchoring flaps 18 and 26 of adjacent blanks B and C. By this means, substantial economy of material is achieved in accordance with a feature of this invention.

We claim:

1. An article, carrier formed from a blank comprising a bottom wall, a first side wall foldably joined along the bottom edge thereof to one side edge of said bottom wall, a first pair of end panels foldably joined respectively along the outer edges thereof to opposite end edges of said first side wall, a first riser panel foldably joined along one edge thereof to the inner edge of one of said first pair of end panels, a first medial panel foldably joined along an end edge thereof to the inner edge of the other of said first pair of end panels, a first handle panel foldably joined along an end edge thereof to said end edge of said first medial panel, a second handle panel foldably joined along an upper medial edge thereof to said first handle panel, a second medial panel foldably joined along an end edge thereof to an end edge of said second handle panel, a longitudinal reinforcing beam panel foldably joined along an upper edge thereof to a lower edge of said second medial panel, a third end panel foldably joined along an inner edge thereof to said end edge of said second medial panel, a second side wall foldably joined along one end edge thereof to an outer edge of said third end panel, a fourth end panel foldably joined along an outer edge thereof to the other end edge of said second side wall, and a second riser panel foldably joined along an outer edge thereof to the inner edge of said fourth end panel and foldably joined along the upper edge thereof to the upper edge of said first riser panel.

2. A carrier according to claim 1 wherein cross partition structure is foldably joined to each of said medial panels.

3. A carrier according to claim 2 wherein at least one of said medial panels and its associated cross partition structure provides a recess dimensioned so as to permit substantial nesting with the bottom wall of an adjacent blank.

4. A carrier according to claim 2 wherein each of said cross partition structures includes a pair of partition straps foldably joined along their inner ends to the associated medial panel and wherein an anchoring panel is foldably joined to each pair of partition straps along the outer ends thereof.

5. A carrier according to claim 1 wherein said first and said second medial panels are foldably joined along the upper edges thereof.

6. A carrier according to claim 1 wherein said end edges of said first and second medial panels are in coaxial alignment with each other.

7. A carrier according to claim 1 wherein said first and second handle panels are foldably joined along the upper edges thereof.

8. A carrier according to claim 1 wherein a glue flap is foldably joined to the bottom edge of said second side wall.

9. An article carrier comprising a bottom wall, side walls foldably joined along their bottom edges to opposite side edges of said bottom wall, end panels foldably joined to the end edges of said side walls and projecting upwardly, riser panels foldably joined respectively to the inner edges of said end panels at one end of the carrier and projecting medially inward, medial panels foldably joined to said end panels respectively at the other end of the carrier and secured to said riser panels, handle panels foldably joined respectively to said medial panels and secured thereto, and a longitudinal reinforcing beam panel foldably joined along an upper edge thereof to a lower edge of one of said medial panels and secured at one end thereof to the other of said medial panels and secured at the other end thereof to one of said riser panels.

10. A nested arrangement of two groups of three each carrier blanks formed in accordance with claim 3, said blanks being arranged one above the other and struck from a common sheet of paperboard whereby the second blank is disposed in a position which is rotated clockwise 180 degrees with respect to the first blank and the third blank is disposed in the same general orientation as the second blank but offset to one side thereof, the bottom wall of each of said first and second blanks being arranged to extend into the recess provided in the adjacent one of said medial panels of said first and second blank so that the exposed end edge of each of said bottom walls is substantially aligned with the free end edge of the respective one of said cross partition structures, the bottom wall of said third blank being disposed in close nested relation adjacent said longitudinal reinforcing beam of said second blank and the exposed end edge of said bottom wall of said third blank being substantially aligned with the exposed end edge of said longitudinal reinforcing beam associated with said second blank.

11. A nested arrangement of two groups of three carrier blanks each which are struck from a common sheet of paperboard each blank being formed according to claim 2 wherein the bottom wall of each of two of said blanks is arranged with the outer side edge thereof in close nested relation with a first cross partition structure of the other of said two blanks and wherein an end edge of each of said bottom walls of each of said two blanks is in close nested relation with an inner end edge of the medial panel of the other of said two blanks and wherein an edge of said longitudinal reinforcing beam is disposed in close nested relation with the outer side edge of the bottom wall of a third carrier blank and a part of an end edge of said bottom wall of said third blank being in close nested relation with a part of the bottom edge of a medial panel of one of said two blanks.

* * * * *